United States Patent [19]

Romanauskas

[11] 4,414,106

[45] Nov. 8, 1983

[54] METHOD AND APPARATUS FOR IMPROVING SEDIMENTATION FIELD FLOW FRACTIONATION CHANNELS

[75] Inventor: William A. Romanauskas, Southbury, Conn.

[73] Assignee: E. I. Du Pont de Nemours & Co., Wilmington, Del.

[21] Appl. No.: 352,077

[22] Filed: Feb. 25, 1982

Related U.S. Application Data

[63] Continuation of Ser. No. 249,964, Apr. 1, 1981, abandoned.

[51] Int. Cl.[3] ..... B03B 5/00

[52] U.S. Cl. ..... 209/155; 209/172; 494/85

[58] Field of Search ..... 209/1, 11, 208, 444, 209/453, 172, 155, 207; 233/1 E, 1 R, 1 A, 10, 14 R, 23 R, 25, 26, 27; 301/5 BA

[56] References Cited

U.S. PATENT DOCUMENTS

| | | | |
|---|---|---|---|
| 1,209,730 | 12/1916 | Leblanc | 301/5 BA |
| 2,193,734 | 3/1940 | MacCracken | 301/5 BA |
| 2,528,974 | 11/1950 | Ritsch | 209/172 X |
| 2,612,267 | 9/1952 | Vogel | 209/172 |
| 3,463,551 | 8/1969 | Clay | 301/5 BA |
| 3,523,610 | 8/1970 | Purcell et al. | 209/155 |
| 4,285,809 | 8/1981 | Dilks et al. | 209/155 |

FOREIGN PATENT DOCUMENTS

| | | | |
|---|---|---|---|
| 2746877 | 4/1979 | Fed. Rep. of Germany | 233/1 E |

*Primary Examiner*—Ralph J. Hill

[57] ABSTRACT

The channel in a sedimentation field flow fractionation apparatus is improved by the use of a heavy liquid layer formed of a water immiscible, chemically inert, non-toxic material. This thin, heavy liquid layer prevents the sample from plating on the outer channel wall thereby permits a less perfect finish to be formed and to some degree corrects lack of circularity of the channel. Where multiple channels are used, the use of this layer reduces leakage between adjacent channels.

2 Claims, 5 Drawing Figures

METHOD AND APPARATUS FOR IMPROVING SEDIMENTATION FIELD FLOW FRACTIONATION CHANNELS

CROSS REFERENCE TO RELATED APPLICATIONS

This is a continuation of application Ser. No. 249,964, filed Apr. 1, 1981, now abandoned.

This application is related to inventions described in copending applications Ser. No. 125,855, filed Feb. 29, 1980, now U.S. Pat. No. 4,283,276, issued Aug. 11, 1981, entitled "Rotor for Sedimentation Field Flow Fractionation", by John Wallace Grant and Ser. No. 249,963 filed Apr. 1, 1981, entitled "Field Flow Fractionation Channel", by William Andrew Romanauskas.

BACKGROUND OF THE INVENTION

Sedimentation field flow fractionation is a versatile technique for the high resolution separation of a wide variety of particulates suspended in a fluid medium. The particulates including macromolecules in the $10^5$ to the $10^{13}$ molecular weight (0.0001 to 1 $\mu$m) range, colloids, particles, unicelles, organelles and the like. The technique is more clearly described and more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

Field flow fractionation is the result of the differential migration rate of components in a carrier or mobile phase in a manner similar to that experienced in chromatography. However, in field flow fractionation there is no separate stationary phase as is in the case of chromatography. Sample retention is caused by the redistribution of sample components between the fast to the slow moving strata within the mobile phase. Thus, particulates elute more slowly than the solvent front. Typically a field flow fractionation channel consists of two closely spaced parallel surfaces. A mobile phase is caused to flow continuously through the gap between the surfaces. Because of the narrowness of this gap or channel (typically 0.025 centimeters (cm)), the mobile phase flow is laminar with a characteristic parabolic velocity profile. The flow velocity is the highest at the middle of the channel and the lowest near the two channel surfaces.

An external force field of some type (the force fields include gravitational, thermal, electrical, fluid cross flow and others described variously by Giddings and Berg and Purcell), is applied transversely (perpendicular) to the channel surfaces or walls. This force field pushes the sample components in the direction of the slower moving liquid strata near the outer wall. The buildup of sample concentration near the wall, however, is resisted by the normal diffusion of the particulates in a direction opposite to the force field. This results in a dynamic layer of component particles, each component with an exponential-concentration profile. The extent of retention is determined by the time-average position of the particulates within the concentration profile which is a function of the balance between the applied field strength and the opposing tendency of particles to diffuse.

In sedimentation field flow fractionation, use is made of a centrifuge to establish the force field required for the separation. For this purpose, a long, thin annular belt-like channel is made to rotate within a centrifuge.

The resultant centrifugal force causes components of higher density than the mobile phase to settle toward the outer wall of the channel. For equal particle density, because of their higher diffusion rate, smaller particulates will accumulate into a thicker layer against the outer wall than will larger particulates. On the average, therefore, larger particulates are forced closer to the outer wall.

If now the fluid medium, which may be termed a mobile phase or solvent is fed continuously in one end of the channel, it carries the sample components through the channel for later detection at the outlet of the channel. Because of the shape of the laminar velocity profile within the channel and the placement of particulates in that profile, solvent flow causes smaller particulates to elute first, followed by a continuous elution of sample components in the order of ascending particulate mass.

One of the problems encountered in the use of thin channels is that the finish of the channel walls must be exceedingly smooth or else the separated particles, while undergoing their Brownian motion and under the influence of centrifugal force, can contact the wall and sometimes become stuck in the various interstices of such walls. At the very least, this tends to impede the flow of the particulates through the channel as desired and hence reduces the efficiency of the separation. One can tend to overcome a large part of this problem by making an extremely smooth wall finish. However, this is expensive and not always possible.

A related problem is that it is extremely difficult to make the relatively thin channels of constant radius so that they are perfectly circular. If the channel is not circular, the points of the channel that lie in a greater radial distance will be subjected to a different centrifugal force than those of a lesser radial distance. This leads to further decreases in the efficiency and resolution of the separation.

A final but related problem, which exists when multiple channels are used in side by side relation, is the leakage that can occur between the channels. This also leads to a degradation of result.

SUMMARY OF THE INVENTION

Many of these deficiencies encountered with the prior art sedimentation field flow fractionation channels are overcome by apparatus constructed in accordance with this invention. In this apparatus, means are provided to isolate the fluid medium containing particulates from at least a portion of the outer wall of the flow channel. This isolating means includes positioning a liquid layer having a density greater than the density of the fluid medium against the outer wall. With such isolation, there is reduced contact between the particulates in the fluid medium with the outer wall and hence less tendency of the particulates to become trapped or unduly slowed in their movement through the flow channel by the outer wall.

In a preferred embodiment, the volume of the liquid layer is limited to cover the outer channel wall to a radial depth just sufficient to cover many of the surface discontinuities. In still another embodiment, the liquid layer is limited in volume to cover portions of the outer wall of the channel which lie at the greater radial distances thereby to partially compensate for acircularity of the channel.

When the channel is constructed of an outer support ring and an inner ring having an outer peripheral groove mating with the outer ring to define the channel, the liquid layer serves to reduce leakage of the fluid medium at the line of seal contact between the rings. Leakage is reduced because any minor leakage that occurs is of the high density liquid layer rather than the fluid material being processed. In those cases where the channel constitutes several spiral turns, the liquid layer tends to reduce leakage between adjacent grooves constituting the channel. There can be no leakage of the fluid medium since the region of contact between the inner and outer rings is the liquid layer material and not the fluid particulate medium.

According to the method of this invention, particles suspended in a fluid medium are separated according to their effective masses using an annular channel having a cylinder axis and radially inner and outer walls defining the radial thickness of the channel. The method includes the steps of rotating the channel about its axis, passing the fluid medium through the channel, introducing the particulates into the medium for passage through the channel, and introducing a liquid layer having a density greater than that of the fluid medium into the channel to form, by the centrifugal force on the rotating channel, a layer of the liquid on the outer wall, thereby to at least partially isolate the outer wall from the fluid medium and at least partially correct for acircularity of the channel.

BRIEF DESCRIPTION OF THE DRAWINGS

Further advantages and features of this invention will become apparent from the following description wherein.

DETAILED DESCRIPTION OF THE PREFERRED EMBODIMENT

Figures 1, 2:
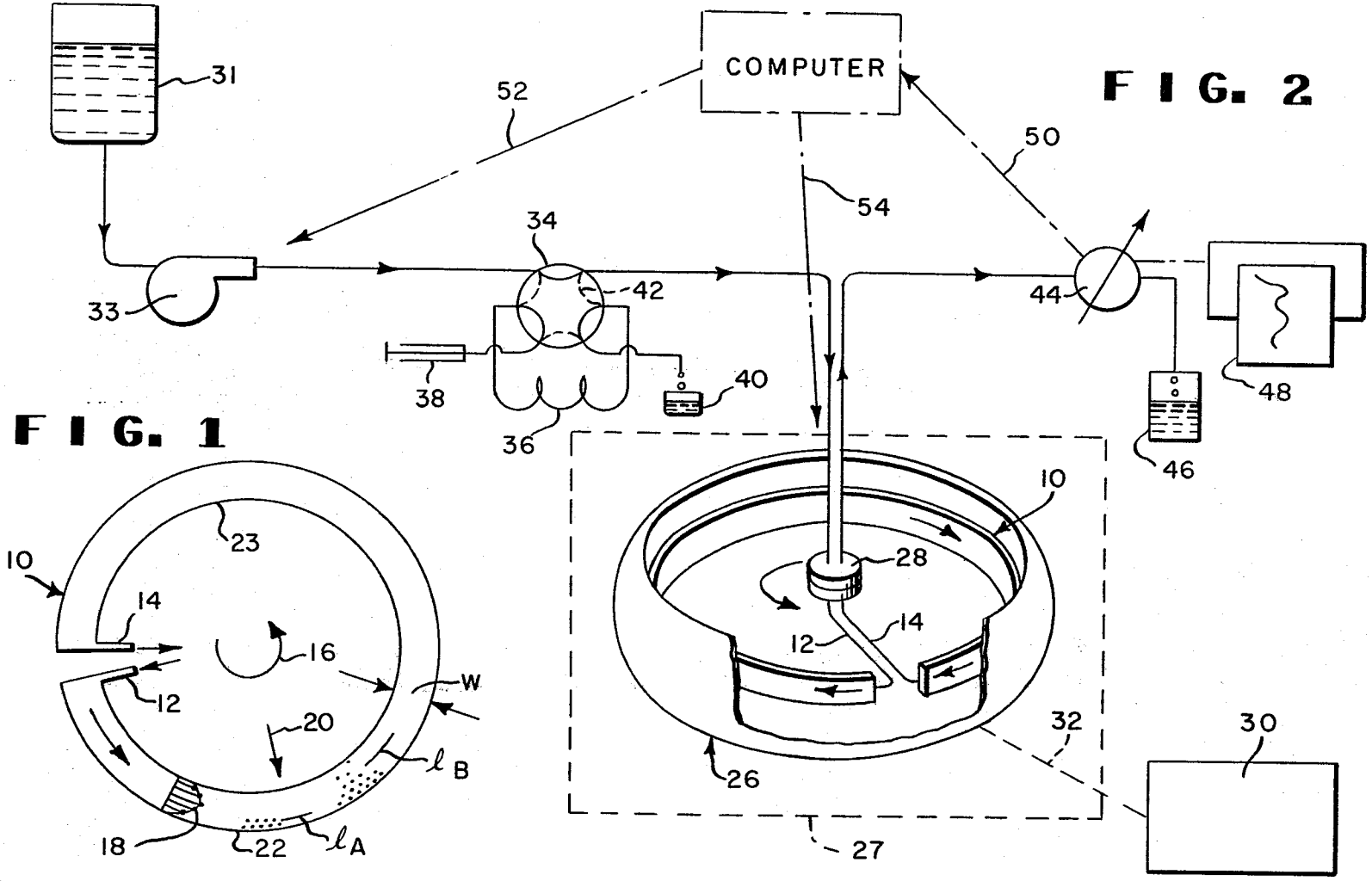
FIG. 1 is a simplified schematic representation of the sedimentation field flow fractionation technique.
FIG. 2 is a partial schematic, partially pictorial representation of a typical sedimentation field flow fractionation separation apparatus in which this invention finds use.

A typical sedimentation field flow fractionation apparatus with which this invention may find use is perhaps more easily understood with reference to FIGS. 1 and 2. In FIG. 1 there may be seen as annular ringlike (alternatively, belt-like or ribbonlike) channel 10 having a relatively small thickness (in the radial dimension) designated W. The channel has an inlet 12 in which the fluid medium (hereinafter referred to as the mobile phase, liquid or simply fluid) is introduced together with, at some point in time, a small sample of a particulate to be fractionated, and an outlet 14. The annular channel is spun or rotated in either sense about a spin axis, i.e., its cylinder axis. For purposes of illustration the channel is illustrated as being rotated in a counterclockwise sense denoted by the arrow 16. Typically, the thickness of these channels may be in the order of magnitude of 0.025 cm; actually, the smaller the channel thickness, the greater the rate at which separations can be achieved.

In any event, because of the thin channel, fluid flow is laminar and assumes a parabolic flow velocity profile across the channel thickness, as denoted by the reference numeral 18. The channel 10 is defined by an outer surface or wall 22 and an inner surface or wall 23. If now a radial centrifugal force field F, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field F and by opposing normal diffusion forces due to Brownian motion. Because the particulates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $l_A$ (FIG. 1) and that is less than that of smaller particulates $L_B$ (FIG. 1).

The fluid in the channel is now caused to flow at a uniform speed, so as to establish the parabolic profile of flow 18. In this laminar flow situation, the closer a liquid layer is to the wall, the slower it flows. During the interaction of the compressed cloud of particulates with the flowing fluid, sufficiently large particulates will interact with layers of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid", I-Theory, by Howard C. Berg and Edward M. Purcell, Proceedings of the National Academy of Sciences, Vol. 58, No. 3, pages 862–869, September 1967.

The channel 10 may be constructed as described by Berg and Purcell or of a split ring configuration as is described in the Grant application Ser. No. 125,850, filed Feb. 29, 1980, now U.S. Pat. No. 4,284,497, issued Aug. 18, 1981, entitled "Rotor for Sedimentation Field Flow Fractionation". This application describes a split inner ring configuration for contructing an SFFF channel having a rectangular cross section and a relatively small (0.025 cm) radial thickness. Alternatively, the channel described in the Romanauskas application Ser. No. 249,961, filed Apr. 1, 1981 entitled "Field Flow Fractionation Channel", by W. A. Romanauskas may be used.

The flow channel may be housed within a bowl-type rotor such as that depicted in FIG. 2 or it may be simply supported by a spider type configuration which is mounted to be driven on a conventional gyro drive of a centrifugal (not shown) or it may be mounted as described by Romanauskas.

Figure 3:
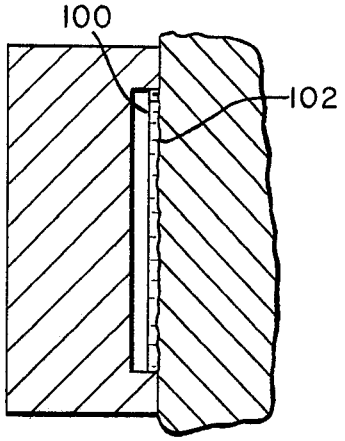
FIG. 3 is a fragmentary cross sectional view of a sedimentation field flow fractionation channel with the liquid layer of this invention smoothing the outer wall surface.

Whatever the channel used, in accordance with the method of this invention, a liquid having a density greater than the density of the fluid medium is introduced into the channel. This liquid under the influence of centrifugal force, disperses itself over the outer wall 102 of the channel to form a liquid layer 100. As may be seen in FIG. 3, the outer channel wall 102 is shown in a greatly exaggerated manner to have a roughness with crevices and intersticial spaces in which particulates in the fluid medium would normally become trapped or slowed. With this invention, the liquid layer 100 by having a higher density than that of the fluid medium in the channel, plates itself along the outer wall thereby covering up many, if not all, of the intersticial spaces and provides a smooth outer surface of the fluid medium.

This heavy liquid layer should have a density greater than that of the fluid medium and that of the particulates in the medium, should be immiscible with the materials normally used for the fluid medium, should be chemically inert, and nontoxic particularly to biological materials. Various of the Freon ® fluorinated hydrocarbons sold by E. I. du Pont De Nemours and Company are suitable for this purpose. Another suitable material is a fluorinated hydrocarbon such as that sold under the tradename Fluorinert ® by 3M Company of Minneapolis, MN. For example Fluorinert ® FC48 is described as follows: "'FC48 is a completely fluorinated liquid, with a nominal boiling point of 345° F. It is clear, colorless and odorless, in addition to being nonflammable and essentially nontoxic'. The density of FC48 is 1.93 g/ml at 25° C."

Figure 4:
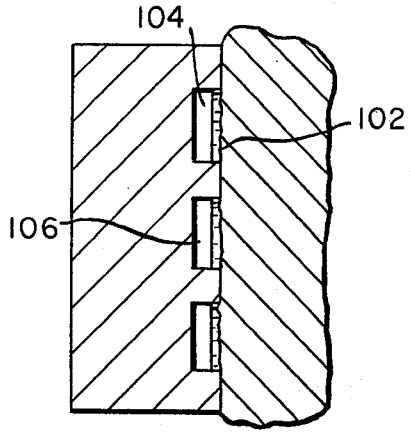
FIG. 4 is a fragmentary cross sectional view of a multiturn sedimentation field flow fractionation channel using the liquid layer of this invention.

When channels having multiple turns are used, such as depicted in FIG. 4, the use of the liquid layer of this invention provides the advantage of aiding and preventing leakage of the fluid medium between turns of the channel. This is accomplished because the liquid layer 100, being heavier than the fluid medium, forms itself as a continuous layer along the outer wall 102 of the channel, preventing the fluid medium from one turn 104 from leaking into the adjacent turn 106.

Figure 5:
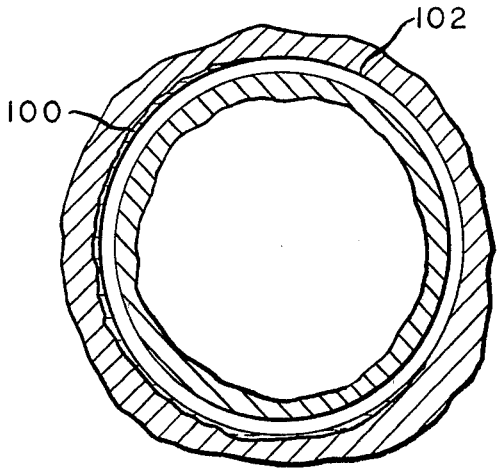
FIG. 5 is a fragmentary plan view of a sedimentation field flow fractionation channel depicting the manner in which the liquid layer can correct for acircularity of the channel.

In still another embodiment of the invention, the heavy liquid may be introduced into the channel, as depicted in FIG. 5, so as to position itself under centrifugal force at the greater radial distances of the outer wall 102. In this manner, the liquid layer 100 tends to correct at least to some extent for minor acircularity of the channel.

It is thus apparent that by using this invention, channels having a cheaper construction and less expensive surface finish may be used. Furthermore, even with channels having smoother, more expensive finishes, by isolating or separating the fluid medium from the outer wall of the channel, there is thus less tendency for the particles to become plated out or caught or have their progress impeded by wall contact and other surface effects. Finally, leakage is prevented firstly because the higher density material has less tendency to leak through this channel seal and further, in the case of the multiple turns, prevents leakage between the adjacent channels. Its correction for acircularity means that channels can be constructed more economically without the high degree of precision that would otherwise be required.

In FIG. 2 there is described, for a completeness of description, a typical system for implementing SFFF. In this figure, the channel 10 may be disposed in a bowl-like or ringlink rotor 26 for support. The rotor 26 may be part of a conventional centrifuge, denoted by the dashed block 27, which includes a suitable centrifuge drive 30 of a known type operating through a suitable linkage 32, also a known type, which may be direct belt or gear drive. Although a bowl-like rotor is illustrated, it is to be understood that the channel 10 may be supported by rotation about its own cylinder axis by any suitable means such as a spider (not shown) or simple ring. The channel has a liquid or fluid inlet 12 and an outlet 14 which is coupled through a rotating seal 28, constructed in accordance with this invention, to the stationary apparatus which comprise the rest of the system. Thus the inlet fluid (or liquid) or mobile phase of the system is derived from suitable solvent reservoirs 30 which are coupled through a conventional pump 32 thence through a two-way, 6-port sampling valve 34, of conventional design, and through a rotating seal 28 to the inlet 12.

Samples whose particulates are to be separated are introduced into the flowing fluid stream by this conventional sampling valve 34 in which a sample loop 36 has either end connected to opposite ports of the valve 34 with a syringe 38 being coupled to an adjoining port. An exhaust receptacle 40 is coupled to the final port. When the sampling valve 34 is in the position illustrated by the solid lines, sample fluid may be introduced into the sample loop 36 with sample flowing through the sample loop to the exhaust receptacle 40. Fluid from the solvent reservoirs 30 in the meantime flows directly through the sample valve 34. When the sample valve 34 is changed to a second position, depicted by the dashed lines 42, the ports move one position such that the fluid stream from the reservoir 30 not flows through the sample loop 36 before flowing to the rotating seal 28. Conversely, the syringe 38 is coupled directly to the exhaust reservoir 40. Thus the sample is carried by the fluid stream to the rotating seal 28.

The outlet line 14 from the channel 10 is coupled through the rotating seal 28 through the channel 10 and out through the rotating seal 28 to a conventional detector 44 and thence to an exhaust or collection receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated, if desired, by allowing the computer to control the operation of the pump 32 and also the operation of the centrifuge 28. Such control is depicted by the dashed lines 52 and 54, respectively.

I claim:

1. In an apparatus for separating particulates suspended in a fluid medium according to their effective masses, said apparatus having an annular cylindrical channel with a cylinder axis and radially inner and outer walls, said channel being comprised of an outer support ring forming said outer wall and an inner ring having an outer groove forming said inner wall, said inner ring forming a mating interface with said outer ring to define said channel there between, means for rotating said channel about said axis, means for passing said fluid medium circumferentially through said channel, and means for introducing said particulates into said medium for passage through said channel, the improvement of means to reduce leakage of said fluid medium at the mating interface between said rings by positioning a liquid layer having a density greater than the density of said fluid medium on said outer wall.

2. The apparatus of claim 1 wherein said inner ring forms plural circumferential outer grooves defining plural channels, whereby said liquid layer reduces leakage of said fluid medium between said grooves.

* * * * *